United States Patent [19]

Ross

[11] Patent Number: 4,953,780

[45] Date of Patent: Sep. 4, 1990

[54] POSTCARD WITH PERSONAL PHOTOGRAPH

[76] Inventor: Thomas H. Ross, 4525 E. Gainey Ranch Rd. #254g330401, Scottsdale, Ariz. 85258

[21] Appl. No.: 402,339

[22] Filed: Sep. 5, 1989

[51] Int. Cl.[5] ..... B42D 15/02; B44C 5/02

[52] U.S. Cl. ..... 229/92.8; 40/158.1

[58] Field of Search ..... 229/92.8; 40/158.1

[56] References Cited

U.S. PATENT DOCUMENTS

| | | | |
|---|---|---|---|
| 3,304,641 | 2/1967 | Gonczy | 40/158.1 |
| 3,713,238 | 1/1973 | Hyman et al. | 229/92.8 |
| 4,273,633 | 12/1980 | Murrell | 229/92.8 |
| 4,777,746 | 10/1988 | Brooks | 40/158.1 |
| 4,825,574 | 5/1989 | George | 40/158.1 |

FOREIGN PATENT DOCUMENTS

| | | | |
|---|---|---|---|
| 01777 | 3/1986 | World Int. Prop. O. | 229/92.8 |

*Primary Examiner*—Stephen P. Garbe

*Attorney, Agent, or Firm*—Don J. Flickinger; Jordan M. Meschkow; Lowell W. Gresham

[57] ABSTRACT

A postcard is entirely covered on one side with adhesive and overlaid with a protective sheet. A weakened line divides the protective sheet into a central portion and a perimetric border portion. In a first application of the invention, the central portion of the protective sheet is removed to expose a space for receiving a photograph of conventional size and the perimetric border portion is left in place to serve as a frame protecting the edges of the photograph. In a second application, both the central portion and the perimetric border portion are removed to expose the entire adhesive-coated surface of the postcard, thus making room for a larger sized photograph.

6 Claims, 1 Drawing Sheet

POSTCARD WITH PERSONAL PHOTOGRAPH

BACKGROUND OF THE INVENTION

1. Field of the Invention

This invention relates to picture postcards.

More particularly, the present invention relates to a postcard with an adhesive surface for carrying a photograph.

In a further and more specific aspect, the instant invention concerns a postcard entirely covered on one side with adhesive and overlaid with a protective sheet, the central portion of which is removed to make room for a conventional sized photograph, and the perimeter of which may either be left in place to form a border for protecting the edges of the conventional sized photograph or removed to accommodate a larger sized photograph.

2. The Prior Art

A conventional picture postcard consists of a sheet of substantially rigid material such as cardboard having a photographic image printed on one side and spaces for carrying an address and a personal message on the other side. Typically, the photographic image on the postcard shows a landmark or scenic spot characteristic of the locality where the postcard is purchased.

Such postcards are extremely popular, and can be found at tourist attractions all over the world. Nevertheless, many individuals find these mass-produced postcards too impersonal, and would prefer to send more creative correspondence. As a result, various attempts have been made to produce "do-it-yourself" postcards which allow the sender to affix his own photographs, and thus express his individuality without spending as much time as is required for a full-fledged letter.

Each of the "do-it-yourself" postcards proposed to date has suffered from one or more shortcomings which have prevented the cards from finding widespread commercial acceptance. For instance, many of the cards are designed only to receive conventional sized photographs. Larger photographs must be trimmed or not used at all. In addition, many of the prior art cards do not provide any means for centering a conventional sized photograph with respect to the surface of the card. Consequently, the photograph may be crookedly mounted, making the card look amateurish and unattractive. Other cards lack means for protecting the corners of the photographs, leaving them to vulnerable to bending and tearing. Still other cards are costly and difficult to mass produce.

It would be highly advantageous, therefore, to remedy the foregoing and other deficiencies inherent in the prior art.

Accordingly, it is an object of the present invention to provide a postcard with means for affixing a personal photograph.

Another object of the invention is the provision of a postcard of a given size with a frame for protecting the edges of a photograph of a smaller size mounted on the surface of the postcard.

And another object of the invention is to provide a postcard with an adhesive coating on one side and a protective sheet overlying the adhesive coating, wherein the protective sheet is divided into a central portion, which is removed to expose a space for mounting a small photograph, and a perimetric border portion, which may be left in place to protect the edges of the small photograph or removed to accommodate a larger photograph.

Still another object of the invention is the provision of a postcard with means for holding a photograph in a centered position on one side of the postcard.

Yet another object of the invention is to provide a postcard with an adhesive coating for receiving a photograph of the same dimensions as the postcard.

Yet still another object of the invention is the provision of an adhesive-covered postcard with a protective sheet divided into central and perimetric border portions, and a tab for facilitating separation of the central portion from the border portion.

And a further object of the invention is to provide a postcard, according to the foregoing, which is relatively inexpensive to mass-produce and comparatively simple and easy to use.

SUMMARY OF THE INVENTION

Briefly, to achieve the desired objects of the instant invention in accordance with the preferred embodiment thereof, one entire side of a postcard is coated with an adhesive for receiving a photograph selected by the sender. Overlying the adhesive coating is a protective sheet which is divided into a central portion and a perimetric border portion. The central and perimetric border portions are divided from one another by a weakened line. Optionally, a tab may be provided for facilitating separation of the portions.

In a first application of the invention, the central portion of the protective sheet is removed to expose a space for mounting a conventional sized photograph, while the perimetric border portion is left in place to protect the edges of the photograph.

In a second application of the invention, both the central and perimetric border portions are removed, thus exposing the entire adhesive surface of the postcard to receive a larger photograph.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which.

DETAILED DESCRIPTION OF THE PREFERRED EMBODIMENT

Figure 1:
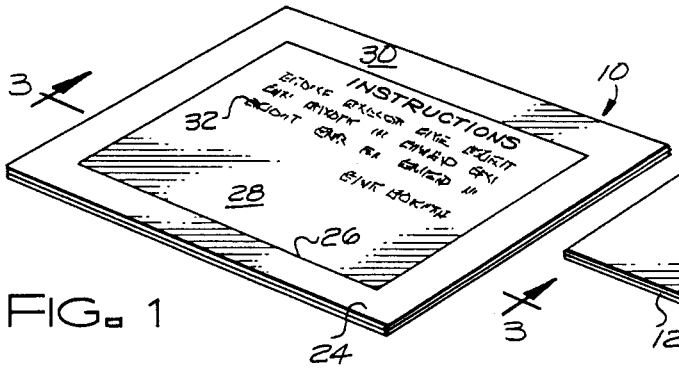
FIG. 1 is a perspective view showing the obverse side of a postcard according to the present invention.
Figure 2:
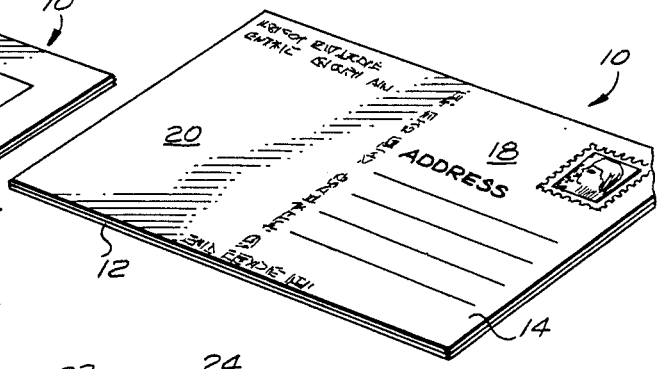
FIG. 2 is a perspective view showing the reverse side of the postcard of FIG. 1.
Figure 3:
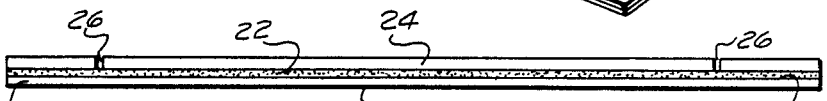
FIG. 3 is a sectional view taken through line 3-3 of FIG. 1.
Figure 4:
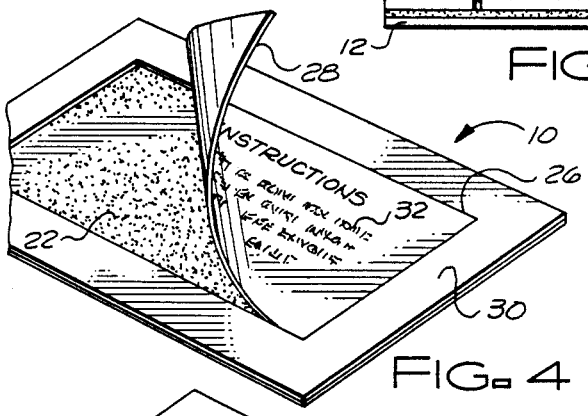
FIG. 4 is a view similar to FIG. 1, showing the central portion of the protective sheet of the postcard being removed to expose the underlying adhesive coating.

Turning now to the drawings in which like reference characters indicate corresponding elements throughout the several views, attention is first directed to FIGS. 1 and 2, which show the obverse and reverse sides, respectively, of a postcard 10 according to the present invention.

The reverse side of the postcard 10 comprises a sheet member 12 made of relatively rigid material such as conventional cardboard. The sheet member includes a first surface 14 and a second surface 16. The first surface 14 is imprinted with indicia for identifying an address area 18 and a message area 20. The second surface 16 is entirely covered with an adhesive coating 22, preferably of the pressure-sensitive type.

The obverse side of the postcard 10 comprises a protective sheet 24 formed of thin plastic or coated paper. A perforated or otherwise weakened line 26 divides the protective sheet 24 into a central portion 28 and a perimetric border portion 30. The central portion 28 may be imprinted with indicia 32 for instructing the sender how to mount a photograph on the postcard 10.

Figure 5:
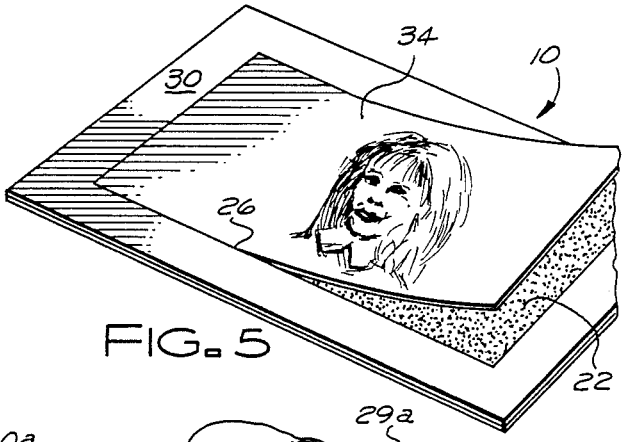
FIG. 5 is a perspective view showing a photograph being mounted on the postcard of FIG. 4.

Postcard 10 preferably measures approximately 4"×6", although the exact dimensions may vary to the extent allowed by postal regulations. Central portion 28 of protective sheet 24 preferably measures 3½"×5", since this corresponds to the most popular size of photograph available from commercial developers. Thus, to mount a 3½"×5" photograph 34 on the postcard 10, it is simply necessary to remove central portion 28 from the protective sheet 24, and to press the photograph 34 into the underlying space, as illustrated in FIG. 5. Perimetric border portion 30 of protective sheet 24, which is preferably of the same thickness as photograph 34, should be left in place to function as a frame for preventing the edges of the photograph 34 from being bumped or lifted.

Figure 8:
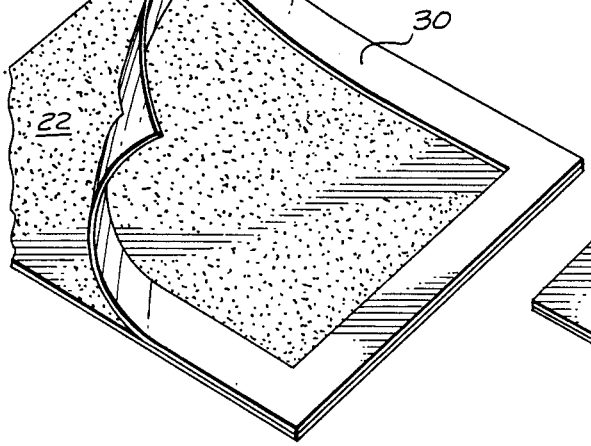
FIG. 8 is a perspective view of the postcard of FIG. 4, showing the border portion of the protective sheet being removed to accommodate a larger photograph.
Figure 9:
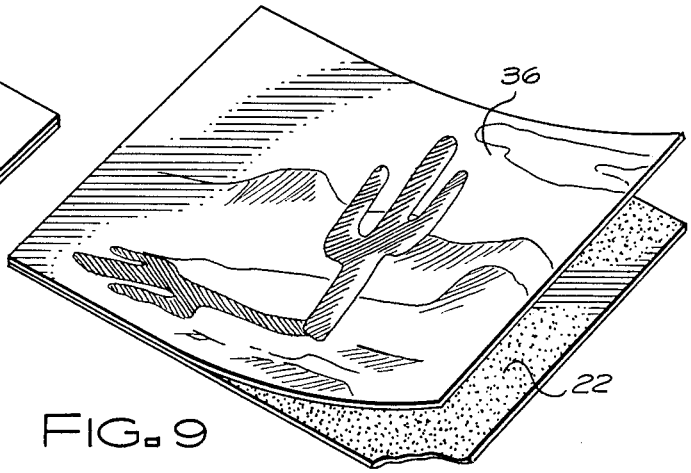
FIG. 9 is a perspective view showing a photograph being mounted on the postcard of FIG. 8.

In an alternative application of the invention, shown in FIGS. 8 and 9, perimetric border portion 30 of protective sheet 24 is also removed, to make room for a larger photograph 36, such as a 4"×6" photograph, the edges of which coincide with the edges of the postcard 10 itself.

Figure 6:
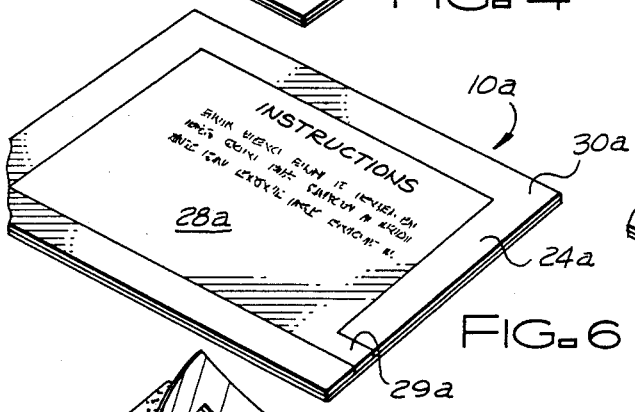
FIG. 6 is a view similar to FIG. 1, showing a postcard according to an alternative embodiment of the invention.
Figure 7:
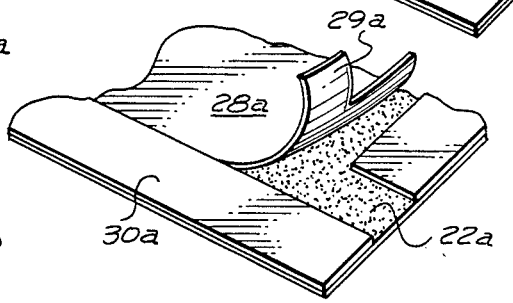
FIG. 7 is an enlarged fragmentary view of the postcard of FIG. 6, with the pull tab partially lifted to expose the underlying adhesive surface.

FIGS. 6 and 7 show another embodiment of the invention which is identical in structure and function to the embodiment described above, with the addition of tab 29*a* which extends from a side of central portion 28*a* to an edge of peripheral border portion 30*a*. The tab 29*a* serves as a grip or handle which allows the sender to easily pull central portion 28*a* off the postcard 1O*a* without disturbing perimetric border portion or frame 30*a*.

Various modifications and variations to the embodiments herein chosen for purposes of illustration will readily occur to those skilled in the art. To the extent that such variations and modifications do not depart from the spirit of the invention, they are intended to be included within the scope thereof which is assessed only by a fair interpretation of the following claims.

Having fully described and disclosed the instant invention and alternately preferred embodiments thereof in such clear and concise terms as to enable those skilled in the art to understand and practice the same, the invention claimed is:

1. A postcard comprising:

(a) a substantially rigid sheet member having a first surface, a second surface, and a plurality of edges, said first surface having a space for an address and a space for a personal message;

(b) adhesive means on said second surface of said sheet member for holding a photograph of a first predetermined size thereon;

(c) a protective sheet for covering said adhesive means, said protective sheet including (i) a central portion overlying said adhesive means, said central portion having a plurality of sides, (ii) a perimetric border portion surrounding said central portion and divided from said central portion by means of a weakened line, said perimetric border portion comprising a plurality of outer edges coextensive with the edges of said sheet member and parallel to the sides of said central portion, and (iii) pull means attached to said central portion for facilitating separation of said central portion from said perimetric border portion, said pull means comprising a tab extending from a side of said central portion to an edge of said perimetric border portion, said central portion being detachable from said perimetric border portion and releasable from said adhesive means to define a space for receiving a photograph.

2. The postcard of claim 1, wherein:

(a) said adhesive means comprises an adhesive coating entirely covering said second surface of said substantially rigid sheet member;

(b) said perimetric border portion of said protective sheet is releasably held by said adhesive coating; and (c) said second surface defines a space for receiving a photograph of a second predetermined size larger than said first predetermined size when both said central portion and said perimetric border portion are removed.

3. The postcard of claim 2, wherein said second predetermined size is equal to the size of said postcard.

4. The postcard of claim 1, wherein said adhesive means is a pressure sensitive adhesive.

5. The postcard of claim 1, wherein the thickness of said border portion is substantially equal to the thickness of said photograph.

6. The postcard of claim 1, further comprising indicia means on said central portion for instructing a user how to mount a photograph on said postcard.

* * * * *